US009889502B2

(12) United States Patent
Ownby et al.

(10) Patent No.: US 9,889,502 B2
(45) **Date of Patent: *Feb. 13, 2018**

(54) INSULATION ENCLOSURE WITH A RADIANT BARRIER

(71) Applicant: Halliburton Energy Services, Inc., Houston, TX (US)

(72) Inventors: Clayton Arthur Ownby, Houston, TX (US); Grant O. Cook, III, Spring, TX (US); Jeffrey G. Thomas, Magnolia, TX (US); Daniel Brendan Voglewede, Spring, TX (US); William Brian Atkins, Houston, TX (US); Ronald Eugene Joy, Katy, TX (US); Michael Clark, Tomball, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 218 days.

This patent is subject to a terminal disclaimer.

(21) Appl. No.: 14/438,971

(22) PCT Filed: Jun. 25, 2014

(86) PCT No.: PCT/US2014/043989

§ 371 (c)(1),
(2) Date: Apr. 28, 2015

(87) PCT Pub. No.: WO2015/199666

PCT Pub. Date: Dec. 30, 2015

(65) Prior Publication Data

US 2015/0375299 A1 Dec. 31, 2015

(51) Int. Cl.
*B22D 27/00* (2006.01)
*B22D 27/04* (2006.01)
(Continued)

(52) U.S. Cl.
CPC ..... *B22D 27/04* (2013.01); *B22D 27/003* (2013.01); *B22D 27/15* (2013.01); *B22D 30/00* (2013.01); *B22D 45/00* (2013.01)

(58) Field of Classification Search
CPC ..... B22D 27/045; B22D 15/04
(Continued)

(56) References Cited

U.S. PATENT DOCUMENTS 3,405,220 A * 10/1968 Barrow ..... B22D 27/04 164/127
4,113,473 A 9/1978 Gauvry et al.
(Continued)

FOREIGN PATENT DOCUMENTS

GB 2343194 A 5/2000
GB 2364529 A 1/2002
(Continued)

OTHER PUBLICATIONS

International Search Report and Written Opinion for PCT/US2014/043989 dated Mar. 23, 2015.

*Primary Examiner* — Scott Kastler
(74) *Attorney, Agent, or Firm* — McDermott Will & Emery LLP

(57) ABSTRACT

An example insulation enclosure includes a support structure having at least an inner frame and providing a top end, a bottom end, and an opening defined in the bottom end for receiving a mold within an interior of the support structure, and a radiant barrier positioned within the interior of the support structure, the radiant barrier including a front surface arranged to face the mold and a back surface facing the support structure, wherein the radiant barrier interposes the mold and the support structure to redirect thermal energy radiated from the mold back towards the mold.

21 Claims, 4 Drawing Sheets

(51) Int. Cl.
*B22D 45/00* (2006.01)
*B22D 27/15* (2006.01)
*B22D 30/00* (2006.01)

(58) Field of Classification Search
USPC ..... 164/135
See application file for complete search history.

(56) References Cited

U.S. PATENT DOCUMENTS

| | | | | |
|---|---|---|---|---|
| 6,035,924 | A | 3/2000 | Graham | |
| 6,220,117 | B1 | 4/2001 | Butcher | |
| 2009/0301682 | A1 | 12/2009 | Proske et al. | |
| 2010/0278604 | A1 | 11/2010 | Glass et al. | |
| 2013/0180692 | A1* | 7/2013 | Gomez | B23K 37/006 165/135 |
| 2015/0375299 | A1* | 12/2015 | Ownby | B22D 30/00 164/61 |
| 2016/0288202 | A1* | 10/2016 | Cook, III | B22F 3/003 |
| 2016/0305191 | A1* | 10/2016 | Cook, III | C21D 9/663 |
| 2016/0339515 | A1* | 11/2016 | Atkins | B22D 33/005 |

FOREIGN PATENT DOCUMENTS

| | | | |
|---|---|---|---|
| JP | 2014008775 | A | 1/2014 |
| WO | 2015199666 | A1 | 12/2015 |

* cited by examiner

INSULATION ENCLOSURE WITH A RADIANT BARRIER

BACKGROUND

The present disclosure is related to oilfield tools and, more particularly, to an insulation enclosure with a radiant barrier that helps control the thermal profile of drill bits during manufacture.

Rotary drill bits are often used to drill oil and gas wells, geothermal wells, and water wells. One type of rotary drill bit is a fixed-cutter drill bit having a bit body comprising matrix and reinforcement materials, i.e., a "matrix drill bit" as referred to herein. Matrix drill bits usually include cutting elements or inserts positioned at selected locations on the exterior of the matrix bit body. Fluid flow passageways are formed within the matrix bit body to allow communication of drilling fluids from associated surface drilling equipment through a drill string or drill pipe attached to the matrix bit body. The drilling fluids lubricate the cutting elements on the matrix drill bit.

Matrix drill bits are typically manufactured by placing powder material into a mold and infiltrating the powder material with a binder material, such as a metallic alloy. The various features of the resulting matrix drill bit, such as blades, cutter pockets, and/or fluid-flow passageways, may be provided by shaping the mold cavity and/or by positioning temporary displacement material within interior portions of the mold cavity. A preformed bit blank (or steel shank) may be placed within the mold cavity to provide reinforcement for the matrix bit body and to allow attachment of the resulting matrix drill bit with a drill string. A quantity of matrix reinforcement material (typically in powder form) may then be placed within the mold cavity with a quantity of the binder material.

The mold is then placed within a furnace and the temperature of the mold is increased to a desired temperature to allow the binder (e.g., metallic alloy) to liquefy and infiltrate the matrix reinforcement material. The furnace typically maintains this desired temperature to the point that the infiltration process is deemed complete, such as when a specific location in the bit reaches a certain temperature. Once the designated process time or temperature has been reached, the mold containing the infiltrated matrix bit is removed from the furnace. As the mold is removed from the furnace, the mold begins to rapidly lose heat to its surrounding environment via heat transfer, such as radiation and/or convection in all directions, including both radially from a bit axis and axially parallel with the bit axis. Upon cooling, the infiltrated binder (e.g., metallic alloy) solidifies and incorporates the matrix reinforcement material to form a metal-matrix composite bit body and also binds the bit body to the bit blank to form the resulting matrix drill bit.

Typically, cooling begins at the periphery of the infiltrated matrix and continues inwardly, with the center of the bit body cooling at the slowest rate. Thus, even after the surfaces of the infiltrated matrix of the bit body have cooled, a pool of molten material may remain in the center of the bit body. As the molten material cools, there is a tendency for shrinkage that could result in voids forming within the bit body unless molten material is able to continuously backfill such voids. In some cases, for instance, one or more intermediate regions within the bit body may solidify prior to adjacent regions and thereby stop the flow of molten material to locations where shrinkage porosity is developing. In other cases, shrinkage porosity may result in poor metallurgical bonding at the interface between the bit blank and the molten materials, which can result in the formation of cracks within the bit body that can be difficult or impossible to inspect. When such bonding defects are present and/or detected, the drill bit is often scrapped during or following manufacturing or the lifespan of the drill bit may be dramatically reduced. If these defects are not detected and the drill bit is used in a job at a well site, the bit can fail and/or cause damage to the well including loss of rig time.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to oilfield tools and, more particularly, to an insulation enclosure with a radiant barrier that helps control the thermal profile of drill bits during manufacture.

According to embodiments of the present disclosure, one or more radiant heat barriers may be positioned or arranged within an insulation enclosure to reflect and/or redirect at least a portion of the thermal energy radiated from a mold back toward the mold, and thereby slow the cooling process of the molten contents positioned within the mold. As a result, a more controlled cooling process for the mold may be achieved and the directional solidification of the molten contents within the mold, such as a drill bit or the like, may be optimized. Through directional solidification, any potential defects (e.g., voids) may be formed at higher and/or more outward positions of the mold where they can be machined off later during finishing operations.

Figure 1:
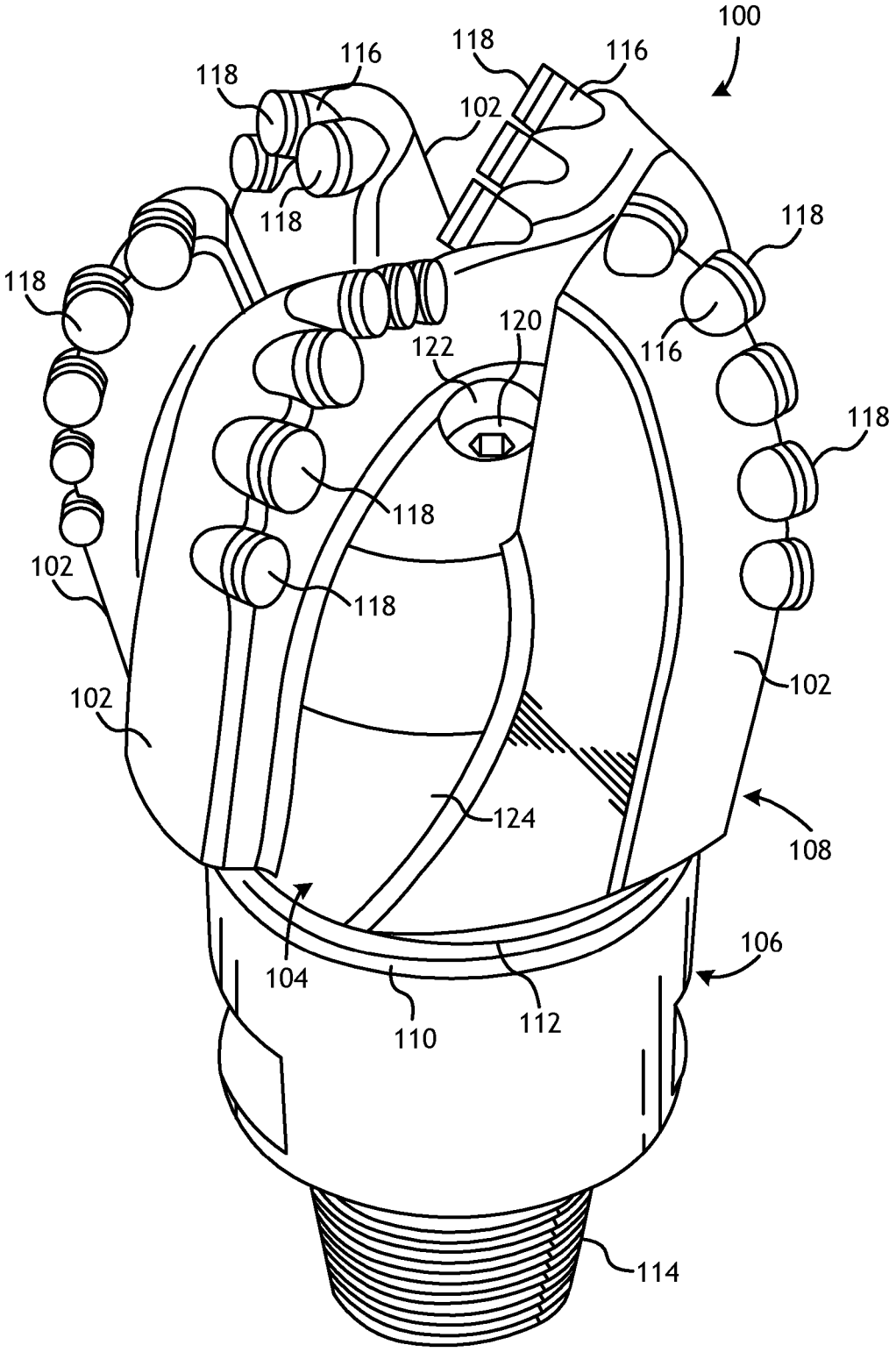
FIG. 1 illustrates an exemplary fixed-cutter drill bit that may be fabricated in accordance with the principles of the present disclosure.

FIG. 1 illustrates a perspective view of an example of a fixed-cutter drill bit 100 that may be fabricated in accordance with the principles of the present disclosure. As illustrated, the fixed-cutter drill bit 100 (hereafter "the drill bit 100") may include or otherwise define a plurality of cutter blades 102 arranged along the circumference of a bit head 104. The bit head 104 is connected to a shank 106 to form a bit body 108. The shank 106 may be connected to the bit head 104 by welding, such as using laser arc welding that results in the formation of a weld 110 around a weld groove 112. The shank 106 may further include or otherwise be connected to a threaded pin 114, such as an American Petroleum Institute (API) drill pipe thread.

In the depicted example, the drill bit 100 includes five cutter blades 102, in which multiple pockets or recesses 116 (also referred to as "sockets" and/or "receptacles") are formed. Cutting elements 118, otherwise known as inserts, may be fixedly installed within each recess 116. This can be done, for example, by brazing each cutting element 118 into a corresponding recess 116. As the drill bit 100 is rotated in use, the cutting elements 118 engage the rock and underlying earthen materials, to dig, scrape or grind away the material of the formation being penetrated.

During drilling operations, drilling fluid (commonly referred to as "mud") can be pumped downhole through a drill string (not shown) coupled to the drill bit 100 at the threaded pin 114. The drilling fluid circulates through and out of the drill bit 100 at one or more nozzles 120 positioned in nozzle openings 122 defined in the bit head 104. Formed between each adjacent pair of cutter blades 102 are junk slots 124, along which cuttings, downhole debris, formation fluids, drilling fluid, etc., may pass and circulate back to the well surface within an annulus formed between exterior portions of the drill string and the interior of the wellbore being drilled (not expressly shown).

Figure 2A:
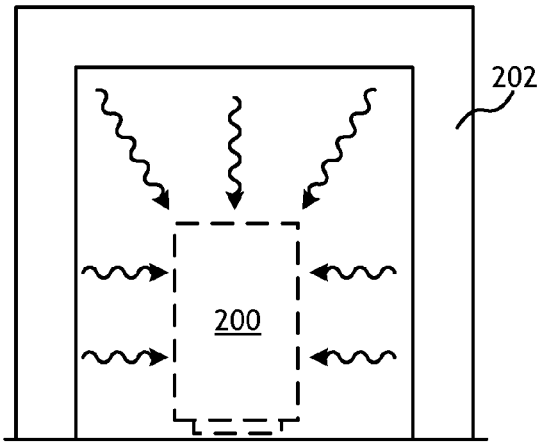
FIGS. 2A-2C illustrate progressive schematic diagrams of an exemplary method of fabricating a drill bit, in accordance with the principles of the present disclosure.
Figure 2B:
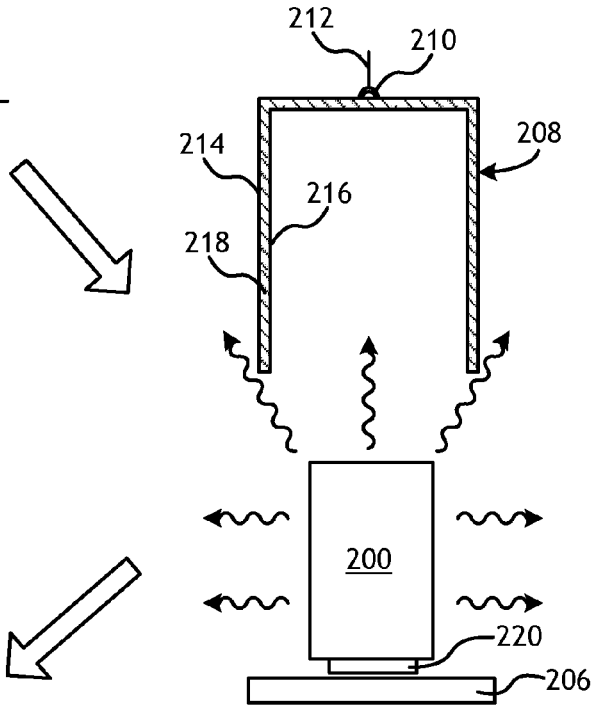
Figure 2C:
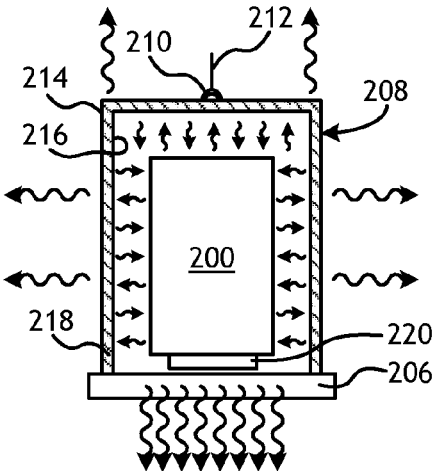

FIGS. 2A-2C are schematic diagrams that sequentially illustrate an example method of fabricating a drill bit, such as the drill bit 100 of FIG. 1, in accordance with the principles of the present disclosure. In FIG. 2A, a mold 200 is placed within a furnace 202. While not specifically depicted in FIGS. 2A-2C, the mold 200 may include and otherwise contain all the necessary materials and component parts required to produce a drill bit including, but not limited to, reinforcement materials, a binder material, displacement materials, a bit blank, etc.

For some applications, two or more different types of matrix reinforcement materials or powders may be positioned in the mold 200. Examples of such matrix reinforcement materials may include, but are not limited to, tungsten carbide, monotungsten carbide (WC), ditungsten carbide ($W_2C$), macrocrystalline tungsten carbide, other metal carbides, metal borides, metal oxides, metal nitrides, natural and synthetic diamond, and polycrystalline diamond (PCD). Examples of other metal carbides may include, but are not limited to, titanium carbide and tantalum carbide, and various mixtures of such materials may also be used. Various binder (infiltration) materials that may be used include, but are not limited to, metallic alloys of copper (Cu), nickel (Ni), manganese (Mn), lead (Pb), tin (Sn), cobalt (Co) and silver (Ag). Phosphorous (P) may sometimes also be added in small quantities to reduce the melting temperature range of infiltration materials positioned in the mold 200. Various mixtures of such metallic alloys may also be used as the binder material.

The temperature of the mold 200 and its contents are elevated within the furnace 202 until the binder liquefies and is able to infiltrate the matrix material. Once a specified location in the mold 200 reaches a certain temperature in the furnace 202, or the mold 200 is otherwise maintained at a particular temperature within the furnace 202 for a predetermined amount of time, the mold 200 is then removed from the furnace 202. Upon being removed from the furnace 202, the mold 200 immediately begins to lose heat by radiating thermal energy to its surroundings while heat is also convected away by cold air from outside the furnace 202. In some cases, as depicted in FIG. 2B, the mold 200 may be transported to and set down upon a thermal heat sink 206. The radiative and convective heat losses from the mold 200 to the environment continue until an insulation enclosure 208 is lowered around the mold 200.

The insulation enclosure 208 may be a rigid shell or structure used to insulate the mold 200 and thereby slow the cooling process. In some cases, the insulation enclosure 208 may include a hook 210 attached to a top surface thereof. The hook 210 may provide an attachment location, such as for a lifting member, whereby the insulation enclosure 208 may be grasped and/or otherwise attached to for transport. For instance, a chain or wire 212 may be coupled to the hook 210 to lift and move the insulation enclosure 208, as illustrated. In other cases, a mandrel or other type of manipulator (not shown) may grasp onto the hook 210 to move the insulation enclosure 208 to a desired location.

In some embodiments, the insulation enclosure 208 may include an outer frame 214, an inner frame 216, and insulation material 218 positioned between the outer and inner frames 214, 216. In some embodiments, both the outer frame 214 and the inner frame 216 may be made of rolled steel and shaped (i.e., bent, welded, etc.) into the general shape, design, and/or configuration of the insulation enclosure 208. In other embodiments, the inner frame 216 may be a metal wire mesh that holds the insulation material 218 between the outer frame 214 and the inner frame 216. The insulation material 218 may be selected from a variety of insulative materials, such as those discussed below. In at least one embodiment, the insulation material 218 may be a ceramic fiber blanket, such as INSWOOL® or the like.

As depicted in FIG. 2C, the insulation enclosure 208 may enclose the mold 200 such that thermal energy radiating from the mold 200 is dramatically reduced from the top and sides of the mold 200 and is instead directed substantially downward and otherwise toward/into the thermal heat sink 206 or back towards the mold 200. In the illustrated embodiment, the thermal heat sink 206 is a cooling plate designed to circulate a fluid (e.g., water) at a reduced temperature relative to the mold 200 (i.e., at or near ambient) to draw thermal energy from the mold 200 and into the circulating fluid, and thereby reduce the temperature of the mold 200. In other embodiments, however, the thermal heat sink 206 may be any type of cooling device or heat exchanger configured to encourage heat transfer from the bottom 220 of the mold 200 to the thermal heat sink 206. In yet other embodiments, the thermal heat sink 206 may be any stable or rigid surface that may support the mold 200, and preferably having a high thermal capacity, such as a concrete slab or flooring.

Accordingly, once the insulation enclosure 208 is arranged about the mold 200 and the thermal heat sink 206 is operational, the majority of the thermal energy is transferred away from the mold 200 through the bottom 220 of the mold 200 and into the thermal heat sink 206. This controlled cooling of the mold 200 and its contents (i.e., the matrix drill bit) allows a user to regulate or control the thermal profile of the mold 200 to a certain extent and may result in directional solidification of the molten contents of the drill bit positioned within the mold 200, where axial solidification of the drill bit dominates its radial solidification. Within the mold 200, the face of the drill bit (i.e., the end of the drill bit that includes the cutters) may be positioned at the bottom 220 of the mold 200 and otherwise adjacent the thermal heat sink 206 while the shank 106 (FIG. 1) may be positioned adjacent the top of the mold 200. As a result, the drill bit may be cooled axially upward, from the cutters 118 (FIG. 1) toward the shank 106 (FIG. 1). Such directional solidification (from the bottom up) may prove advantageous in reducing the occurrence of voids due to shrinkage porosity, cracks at the interface between the bit blank and the molten materials, and nozzle cracks.

While FIG. 1 depicts a fixed-cutter drill bit 100 and FIGS. 2A-2C discuss the production of a generalized drill bit within the mold 200, the principles of the present disclosure are equally applicable to any type of oilfield drill bit or cutting tool including, but not limited to, fixed-angle drill bits, roller-cone drill bits, coring drill bits, bi-center drill bits, impregnated drill bits, reamers, stabilizers, hole openers, cutters, cutting elements, and the like. Moreover, it will be appreciated that the principles of the present disclosure may further apply to fabricating other types of tools and/or components formed, at least in part, through the use of molds. For example, the teachings of the present disclosure may also be applicable, but not limited to, non-retrievable drilling components, aluminum drill bit bodies associated with casing drilling of wellbores, drill-string stabilizers, cones for roller-cone drill bits, models for forging dies used to fabricate support arms for roller-cone drill bits, arms for fixed reamers, arms for expandable reamers, internal components associated with expandable reamers, sleeves attached to an uphole end of a rotary drill bit, rotary steering tools, logging-while-drilling tools, measurement-while-drilling tools, side-wall coring tools, fishing spears, wash-over tools, rotors, stators and/or housings for downhole drilling motors, blades and housings for downhole turbines, and other downhole tools having complex configurations and/or asymmetric geometries associated with forming a wellbore.

Radiant heat flux from the mold 200 once removed from the furnace 202 is proportional to the difference between its temperature raised to the fourth power and the temperature of its immediate surroundings raised to the fourth power (temperature measured in an absolute scale, such as Kelvin). For example, a mold 200 may exit the furnace 202 at a temperature in the 1800° F. to 2500° F. range (1255K to 1644K) and immediately radiate thermal energy to the room-temperature surroundings (approximately 293K) at a high rate. Moreover, once the insulation enclosure 208 is lowered over the mold 200, thermal energy continues to radiate from the mold 200 at a high rate until the temperature of the insulation enclosure 208 is elevated to at or near the temperature of the mold 200. Such high rates of thermal energy being radiated from the mold 200 may accelerate cooling and thereby adversely affect the cooling process of the molten contents within the mold 200.

According to the present disclosure, a radiant barrier may be placed within the insulation enclosure 208 to redirect at least a portion of the thermal energy radiated from the mold 200 back toward the mold 200 and thereby slow the cooling process of the molten contents positioned therein. As a result, a more controlled cooling process for the mold 200 may be achieved and the directional solidification of the molten contents within the mold 200 (e.g., a drill bit) may be optimized. Through directional solidification, any potential defects (e.g., voids) may be more effectively pushed or otherwise urged toward the top regions of the mold 200 where they can be machined off later during finishing operations.

Figure 3:
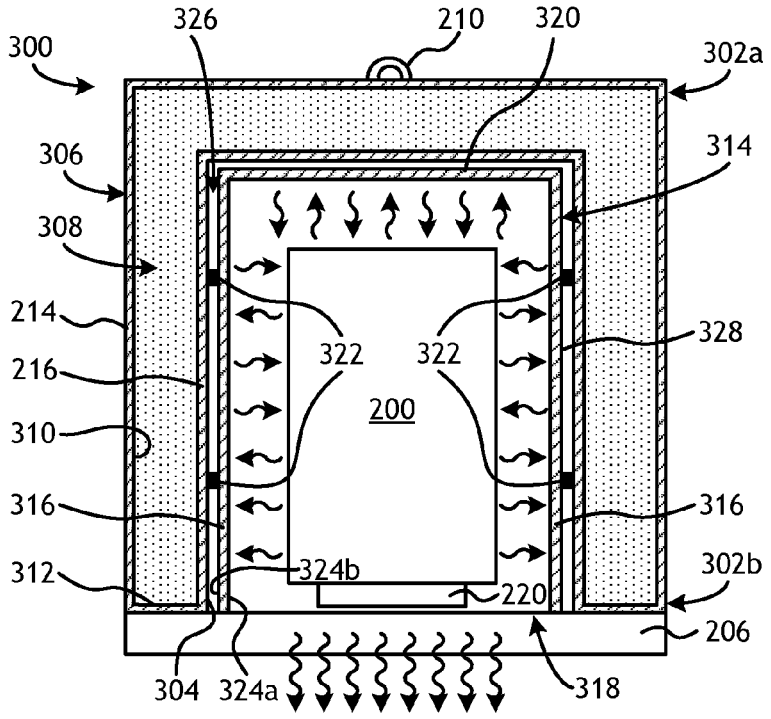
FIG. 3 illustrates a cross-sectional side view of an exemplary insulation enclosure, according to one or more embodiments.

FIG. 3 illustrates a cross-sectional side view of an exemplary insulation enclosure 300 set upon the thermal heat sink 206, according to one or more embodiments. The insulation enclosure 300 may be similar in some respects to the insulation enclosure 208 of FIGS. 2B and 2C and therefore may be best understood with reference thereto, where like numerals indicate like elements or components not described again. The insulation enclosure 300 may include a support structure 306 that defines or otherwise provides the general shape and configuration of the insulation enclosure 300. The support structure 306 may be an open-ended cylindrical structure having a top end 302*a* and bottom end 302*b*. The bottom end 302*b* may be open or otherwise define an opening 304 configured to receive the mold 200 within the interior of the support structure 306 as the insulation enclosure 300 is lowered around the mold 200. The top end 302*a* may be closed and provide the hook 210 on its outer surface, as described above.

In some embodiments, as illustrated, the support structure 306 may include the outer frame 214 and the inner frame 216, as generally described above, and which may be collectively referred to herein as the support structure 306. In other embodiments, however, the outer frame 214 may be omitted and the support structure 306 may be formed of only the inner frame 216, without departing from the scope of the present disclosure.

The support structure 306, including one or both of the outer and inner frames 214, 216, may be made of any rigid material including, but not limited to, metals, ceramics (e.g., a molded ceramic substrate), composite materials, combinations thereof, and the like. In at least one embodiment, the support structure 306, including one or both of the outer and inner frames 214, 216, may be a metal mesh. The support structure 306 may exhibit any suitable horizontal cross-sectional shape that will accommodate the general shape of the mold 200 including, but not limited to, circular, ovular, polygonal, polygonal with rounded corners, or any hybrid thereof. In some embodiments, the support structure 306 may exhibit different horizontal cross-sectional shapes and/or sizes at different locations along the height of the insulation enclosure 300.

In some embodiments, as illustrated, the insulation enclosure 300 may further include insulation material 308 supported by the support structure 306. The insulation material 308 may generally extend between the top and bottom ends 302*a,b* of the support structure 306 and also across the top end 302*a* of the support structure 306, thereby substantially surrounding or encapsulating the mold 200 with the insulation material 308. The insulation material 308 may be supported by the support structure 306 via various configurations of the insulation enclosure 300. For instance, as depicted in the illustrated embodiment, the outer and inner frames 214, 216 may cooperatively define a cavity 310, and the cavity 310 may be configured to receive and otherwise house the insulation material 308 therein. In some embodiments, as illustrated, the support structure 306 may further include a footing 312 at the bottom end 302*b* of the insulation enclosure 300 that extends between the outer and inner frames 214, 216. The footing 312 may serve as a support for the insulation material 308, and may prove especially useful when the insulation material 308 includes stackable and/or individual component insulative materials that may be stacked atop one another within the cavity 310.

In other embodiments, however, as indicated above, the outer frame 214 may be omitted from the insulation enclosure 300 and the insulation material 308 may alternatively be coupled to the inner frame 216 and/or otherwise supported by the footing 312. In yet other embodiments, the inner frame 216 may be omitted from the insulation enclosure 300 and the insulation material 308 may alternatively be coupled to the outer frame 214 and/or otherwise supported by the footing 312, without departing from the scope of the disclosure.

The insulation material 308 may be similar to the insulation material 218 of FIGS. 2B and 2C and may include, but is not limited to, ceramics (e.g., oxides, carbides, borides, nitrides, and silicides that may be crystalline, non-crystalline, or semi-crystalline), polymers, insulating metal composites, carbons, nanocomposites, foams, fluids (e.g., air), any composite thereof, or any combination thereof. The insulation material 308 may further include, but is not limited to, materials in the form of beads, particulates, flakes, fibers, wools, woven fabrics, bulked fabrics, sheets, bricks, stones, blocks, cast shapes, molded shapes, foams, sprayed insulation, and the like, any hybrid thereof, or any combination thereof. Accordingly, examples of suitable materials that may be used as the insulation material 308 may include, but are not limited to, ceramics, ceramic fibers, ceramic fabrics, ceramic wools, ceramic beads, ceramic blocks, moldable ceramics, woven ceramics, cast ceramics, fire bricks, carbon fibers, graphite blocks, shaped graphite blocks, polymer beads, polymer fibers, polymer fabrics, nanocomposites, fluids in a jacket, metal fabrics, metal foams, metal wools, metal castings, metal forgings, and the like, any composite thereof, or any combination thereof.

Suitable materials that may be used as the insulation material 308 may be capable of maintaining the mold 200 at temperatures ranging from a lower limit of about −200° C. (−325° F.), −100° C. (−150° F.), 0° C. (32° F.), 150° C. (300° F.), 175° C. (350° F.), 260° C. (500° F.), 400° C. (750° F.), 480° C. (900° F.), or 535° C. (1000° F.) to an upper limit of about 870° C. (1600° F.), 815° C. (1500° F.), 705° C. (1300° F.), 535° C. (1000° F.), 260° C. (500° F.), 0° C. (32° F.), or −100° C. (−150° F.), wherein the temperature may range from any lower limit to any upper limit and encompass any subset therebetween. Moreover, suitable materials that may be used as the insulation material 308 may be able to withstand temperatures ranging from a lower limit of about −200° C. (−325° F.), −100° C. (−150° F.), 0° C. (32° F.), 150° C. (300° F.), 260° C. (500° F.), 400° C. (750° F.), or 535° C. (1000° F.) to an upper limit of about 870° C. (1600° F.), 815° C. (1500° F.), 705° C. (1300° F.), 535° C. (1000° F.), 0° C. (32° F.), or −100° C. (−150° F.), wherein the temperature may range from any lower limit to any upper limit and encompass any subset therebetween. Those skilled in the art will readily appreciate that the insulation material 308 may be appropriately chosen for the particular application and temperature to be maintained within the insulation enclosure 300.

The insulation enclosure 300 may further include a radiant barrier 314 positioned within the interior of the support structure 306. The radiant barrier 314 may interpose the mold 200 and the support structure and may be configured to redirect thermal energy radiated from the mold 200 back towards the mold 200. As will be appreciated, redirecting radiated thermal energy back towards the mold 200 may help slow the cooling process of the mold 200, and thereby help control the thermal profile of the mold 200 for directional solidification of its molten contents (e.g., a drill bit).

In at least one embodiment, as illustrated, the radiant barrier 314 may be an open-ended cylindrical structure having one or more sidewalls 316 that define a barrier opening 318 and a cap 320 that joins the sidewalls 316 at or near the top end 302*a* of the support structure 306. In some embodiments, the shape and configuration of the sidewalls 316 and the cap 320 may generally conform to the shape and configuration of the interior of the support structure 306. Accordingly, the radiant barrier 314 may be configured to receive the mold 200 through the barrier opening 318 as the insulation enclosure 300 is lowered over the mold 200.

In some embodiments, the radiant barrier 314 may be a free-standing structure separate from the insulation enclosure 300. In other embodiments, however, the radiant barrier 314 may be coupled to the inner surface(s) of the support structure 306 (e.g., the inner frame 216) at one or more discrete locations. As will be appreciated, it may prove advantageous to couple the radiant barrier 314 to the support structure 306 at a minimal number of points or locations to prevent conductive heat losses from the radiant barrier 314 outward to the support structure 306 (e.g., the inner frame 216). In some embodiments, for example, the radiant barrier 314 may be coupled to the support structure 306 using one or more mechanical fasteners 322 (four shown), such as bolts, screws, pins, any combination thereof, or the like. In other embodiments, or in addition thereto, the radiant barrier 314 may be permanently attached to the support structure 306 at one or more discrete locations by a process such as welding, brazing, or diffusion bonding, without departing from the scope of the disclosure. Accordingly, the radiant barrier 314 may provide minimal structural support to the insulation enclosure 300.

In the illustrated embodiment, the radiant barrier 314 may include a front surface 324*a* and a back surface 324*b*. The front surface 324*a* may be arranged such that it faces the mold 200 within the insulation enclosure 300, and the back surface 324*b* may be arranged such that it faces the support structure 306 (e.g., the inner frame 216). The radiant barrier 314 may be made of materials that allow the front surface 324*a* to have a high radiosity (J) and, therefore, be able to substantially redirect thermal energy radiated from the mold 200 back towards the mold 200. The radiosity of a surface is a measure of its effectiveness at projecting radiant energy and is defined as the sum of the emissive power of a surface (E) and reflected incident radiation ($\rho$*G), where reflectivity is denoted as p and G represents incident radiation (or irradiation). The emissive power of a surface is defined as the emissive power of a blackbody surface ($E_b$) scaled by the emissivity of the surface ($\epsilon$). The absorptivity of a surface is defined as the incident radiation that is not reflected ($\alpha=1-\rho$). It then follows that the radiosity encompasses the energy emitted by a surface due to its temperature and radiant energy that is reflected: $3=\epsilon*E_b+(1-\alpha)*G$. A high radiosity can be achieved with a suitable combination of high emissivity ($\epsilon$) and/or low absorptivity ($\alpha$), or a suitably low $\alpha/\epsilon$ ratio. The back surface 324*b* may be prepared such that it exhibits low radiosity, which can be achieved with a suitable combination of low emissivity and/or high absorptivity, or a suitably high $\alpha/\epsilon$ ratio. The back surface 324*b* may also be suitably insulated.

Suitable materials for the radiant barrier 314 include, but are not limited to, ceramics and metals, which may include certain surface preparations or coatings. Suitable ceramics may include aluminum oxide, aluminum nitride, silicon carbide, silicon nitride, quartz, titanium carbide, titanium nitride, borides, carbides, nitrides, and oxides. Suitable metals may include iron, chromium, copper, carbon steel, maraging steel, stainless steel, microalloyed steel, low alloy steel, molybdenum, nickel, platinum, silver, gold, tantalum, tungsten, titanium, aluminum, cobalt, rhenium, osmium, palladium, iridium, rhodium, ruthenium, manganese, niobium, vanadium, zirconium, hafnium, any derivative thereof, or any alloy based on these metals.

Suitable surface preparations may include oxidizing, or any suitable method to modify the surface roughness, such as machining, polishing, grinding, honing, lapping, or blasting. In some embodiments, the emissivity of the front surface 324*a* may further be enhanced by polishing the front surface 324*a* so that a highly reflective surface results.

Suitable coatings may include a metal coating (selected from the previous list of metals and applied via a suitable method, such as plating, spray deposition, chemical vapor deposition, plasma vapor deposition, etc.), a ceramic coating (selected from the previous list of ceramics and applied via a suitable method), or a paint (e.g., white for high reflectivity, black for high absorptivity). The application of a surface preparation or coating can provide important properties for a suitable radiant barrier, as properties such as radiosity, reflectivity, emissivity, and absorptivity are often strongly based on surface properties and conditions. For example, polished aluminum is reported to have the following solar radiative properties: $\alpha_s$=0.09, $\epsilon$=0.03, and $\alpha_s/\epsilon$=3.0. Providing a quartz overcoating or anodizing produce higher emissivities and lower $\alpha/\epsilon$ ratios: $\epsilon$=0.37, $\alpha_s/\epsilon$=0.30 and $\epsilon$=0.84, $\alpha_s/\epsilon$=0.17, respectively, thereby promoting radiosity [Fundamentals of Heat and Mass Transfer, Fifth Edition, Frank P. Incropera and David P. DeWitt, 2002, p. 931]. Due to the strong dependence of radiosity, emissivity, absorptivity, and reflectivity on surface properties and characteristics, a radiant barrier can be designed such that its inner core is a structural member for a suitable coating applied to its surface.

As illustrated, the radiant barrier 314 may be coupled to the support structure 306 such that a gap 326 may be defined therebetween. In some embodiments, the gap 326 may be filled with insulation material, such as the insulation material 308, and used to slow the rate of heat transfer through the insulation enclosure 300. In other embodiments, however, the gap 326 may be filled with air, or another gas, or otherwise be open to the atmosphere, which may help form a secondary radiant barrier or layer of insulation that might further help slow the cooling of the mold 200 within the insulation enclosure 300.

In yet other embodiments, or in addition thereto, a thermal barrier coating 328 may be applied to the back surface 324*b* of the radiant barrier 314 to further lower the rate of heat transfer through to the insulation enclosure 300. The thermal barrier coating 328 may be applied to or otherwise positioned on the back surface 324*b* via a variety of processes or techniques including, but not limited to, electron beam physical vapor deposition, air plasma spray, high velocity oxygen fuel, electrostatic spray assisted vapor deposition, and direct vapor deposition. Accordingly, the thermal barrier coating 328 may advantageously lower the radiosity (e.g., emissivity) of the back surface 324*b* and/or lower the heat transfer through to the insulation enclosure 300, thereby helping maintain heat in the radiant barrier 314, so as to promote its ability to redirect thermal energy back at mold 200. Suitable materials that may be used as the thermal barrier coating 328 include, but are not limited to, aluminum oxide, aluminum nitride, silicon carbide, silicon nitride, quartz, titanium carbide, titanium nitride, borides, carbides, nitrides, and oxides. In at least one embodiment, the thermal barrier coating 328 may alternatively (or in addition thereto) be applied to the support structure 306, such as on the inner and/or outer surfaces of either of the outer and inner frames 214, 216.

Figure 4:
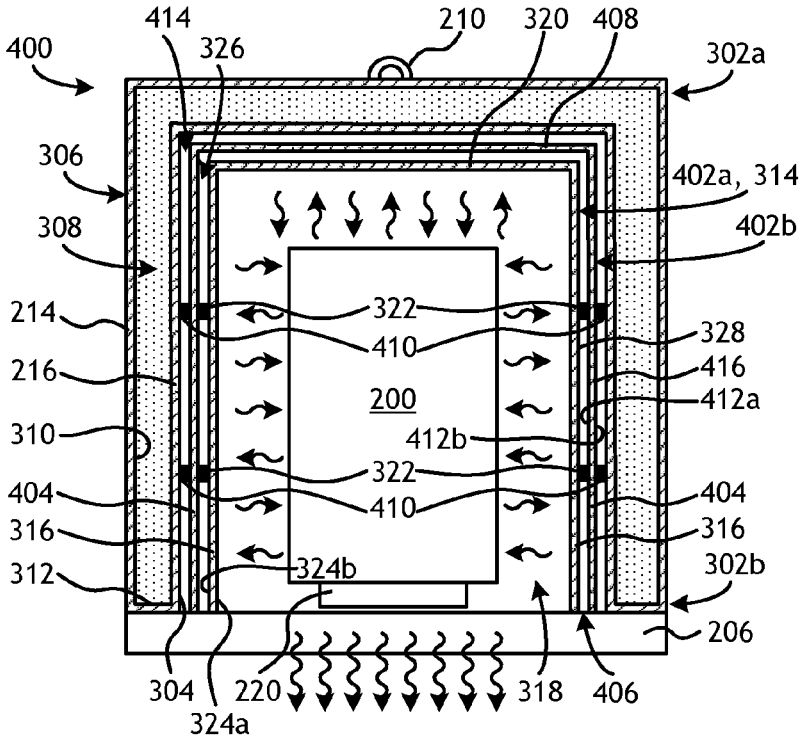
FIG. 4 illustrates a cross-sectional side view of another exemplary insulation enclosure, according to one or more embodiments.

FIG. 4 illustrates a cross-sectional side view of another exemplary insulation enclosure 400, according to one or more embodiments. The insulation enclosure 400 may be similar in some respects to the insulation enclosure 300 of FIG. 3 and therefore may be best understood with reference thereto, where like numerals represent like elements not described again. Similar to the insulation enclosure 300 of FIG. 3, the insulation enclosure 400 may include the support structure 306, including the outer and inner frames 214, 216, and the insulation material 308 supported on the support structure 306, as generally described above.

Unlike the insulation enclosure 300 of FIG. 3, however, the insulation enclosure 400 may include a first radiant barrier 402*a* and a second radiant barrier 402*b*, each positioned within the interior of the support structure 306. The first radiant barrier 402*a* may be substantially similar to the radiant barrier 314 of FIG. 3, and therefore will not be described again. The second radiant barrier 402*b*, however, may interpose the first radiant barrier 402*a* and the support structure 306. While the insulation enclosure 400 is depicted as including the first and second radiant barriers 402*a,b*, those skilled in the art will readily appreciate that more than two radiant barriers 402*a,b* may be employed in the insulation enclosure 400, without departing from the scope of the disclosure. Accordingly, the following description is for illustrative purposes only and should not be considered limiting to the present disclosure.

Similar to the first radiant barrier 402*a* (e.g., the radiant barrier 314 of FIG. 3), the second radiant barrier 402*b* may be configured to redirect thermal energy radiated from the mold 200 back towards the mold 200. More particularly, the second radiant barrier 402*b* may redirect thermal energy from the back surface 324*b* of the first radiant barrier 402*a* back towards the first radiant barrier 402*a*, such that the first radiant barrier 402*a* may lose less thermal energy and/or redirect more thermal energy back towards mold 200. Moreover, the second radiant barrier 402*b* may also be an open-ended cylindrical structure having one or more sidewalls 404 that define a second barrier opening 406 and a cap 408 that joins the sidewalls 404 at or near the top end 302*a* of the support structure 306. The second radiant barrier 402*b* may be configured to receive the first radiant barrier 402*a*, which, in turn, receives the mold 200 as the insulation enclosure 400 is lowered over the mold 200.

As mentioned above, in some embodiments, the first radiant barrier 402*a* (e.g., the radiant barrier 314 of FIG. 3) may be a free-standing structure. In other embodiments, however, the first radiant barrier 402*a* may be coupled to the second radiant barrier 402*b* at one or more discrete locations using, for example, the one or more mechanical fasteners 322 (e.g., bolts, screws, pins, etc.) or by permanently attaching the two components together at a minimal number of points by a process such as welding, brazing, or diffusion bonding. Similar to the first radiant barrier 402*a* (e.g., the radiant barrier 314 of FIG. 3), the second radiant barrier 402*b* may, in some embodiments, also be a free-standing structure. In other embodiments, however, the second radiant barrier 402*b* may be coupled to the inner surface(s) of the support structure 306 (e.g., the inner frame 216) at one or more discrete locations, such as through the use of one or more additional mechanical fasteners 410 (e.g., bolts, screws, pins, etc.) or by permanently attaching the two components together at a minimal number of points by a process such as welding, brazing, or diffusion bonding.

Similar to the first radiant barrier 402*a* (e.g., the radiant barrier 314 of FIG. 3), the second radiant barrier 402*b* may include a front surface 412*a* and a back surface 412*b*. The front surface 412*a* may be arranged such that it faces the back surface 324*b* of the first radiant barrier 402*a*, and the back surface 412*b* may be arranged such that it faces the support structure 306 (e.g., the inner frame 216). The second radiant barrier 402*b* may be made of any of the materials noted above of which the first radiant barrier 402*a* (e.g., the radiant barrier 314 of FIG. 3) may be made. Accordingly, the front surface 412*a* may be configured to have a high radiosity and otherwise be able to substantially redirect thermal energy radiated from the mold 200 back towards the mold 200, as generally described above with reference to the front surface 324*a* of the radiant barrier 314 of FIG. 3. On the other hand, the back surface 412*b* may be prepared such that it exhibits low radiosity or insulating characteristics. In some embodiments, the radiosity of the front surface 412*a* may further be enhanced by polishing the front surface 412*a* so that a highly polished surface results.

As illustrated, the second radiant barrier 402*b* may be coupled to the support structure 306 such that a gap 414 may be defined therebetween. In some embodiments, the gap 414 may be filled with insulation material, such as the insulation material 308, and used to slow the rate of heat transfer through the insulation enclosure 400. In other embodiments, however, the gap 414 may be filled with air or another gas that may help form a layer of insulation that might further slow the cooling of the mold 200 within the insulation enclosure 400.

In yet other embodiments, or in addition thereto, a thermal barrier coating 416 may be applied to the back surface 412*b* of the radiant barrier 402 to further lower the rate of heat transfer through to the insulation enclosure 400. The thermal barrier coating 416 may be similar to the thermal barrier coating 328 of FIG. 3 and, therefore, may advantageously lower the radiosity of the back surface 412*b* and/or lower the heat transfer through to the insulation enclosure 400. In at least one embodiment, the thermal barrier coating 416 may alternatively (or in addition thereto) be applied to the support structure 306, such as on the inner and/or outer surfaces of either of the outer and inner frames 214, 216.

Figure 5:
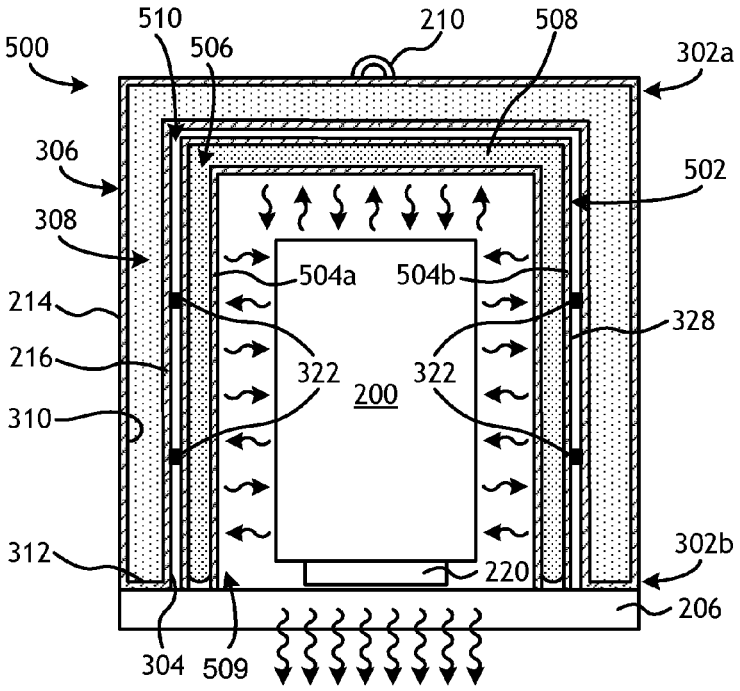
FIG. 5 illustrates a cross-sectional side view of another exemplary insulation enclosure, according to one or more embodiments.

FIG. 5 illustrates a cross-sectional side view of another exemplary insulation enclosure 500, according to one or more embodiments. The insulation enclosure 500 may be similar in some respects to the insulation enclosures 300 and 400 of FIGS. 3 and 4, respectively, and therefore may be best understood with reference thereto, where like numerals represent like elements not described again. Similar to the insulation enclosures 300, 400 of FIGS. 3 and 4, the insulation enclosure 500 may include the support structure 306, including the outer and inner frames 214, 216, and the insulation material 308 supported on the support structure 306, as generally described above. Unlike the insulation enclosures 300, 400 of FIGS. 3 and 4, however, the insulation enclosure 500 may include a different type and/or configuration of radiant barrier used to redirect thermal energy radiated from the mold 200 back towards the mold 200.

More particularly, the insulation enclosure 500 may include a radiant barrier 502 that provides an inner wall 504*a*, an outer wall 504*b*, and a sealed chamber 506 defined between the inner and outer walls 504*a,b*. In some embodiments, however, the outer wall 504*b* may be omitted and the sealed chamber 506 may alternatively be defined between the inner wall 504*a* and the support structure 306 (e.g., the inner frame 216), without departing from the scope of the disclosure. In at least one embodiment, as illustrated, the inner wall 504*a* may be an open-ended cylindrical structure that defines a barrier opening 509 configured to receive the mold 200 as the insulation enclosure 500 is lowered over the mold 200.

The inner and outer walls 504*a,b* may be made of a variety of materials capable of providing structure and rigidity to the sealed chamber 506. Suitable materials for the inner and outer walls 504*a,b* include, but are not limited to, ceramics and metals. Suitable ceramics may include aluminum oxide, aluminum nitride, silicon carbide, silicon nitride, quartz, titanium carbide, titanium nitride, borides, carbides, nitrides, and oxides. Suitable metals may include iron, chromium, copper, carbon steel, maraging steel, stainless steel, microalloyed steel, low alloy steel, molybdenum, nickel, platinum, silver, gold, tantalum, tungsten, titanium, aluminum, cobalt, rhenium, osmium, palladium, iridium, rhodium, ruthenium, manganese, niobium, vanadium, zirconium, hafnium, any derivative thereof, or any alloy based on these metals.

In some embodiments, one or both of the inner and outer walls 504*a,b* may be similar to the radiant barrier 314 of FIG. 3 and otherwise made of materials that allow the front surfaces of the inner and outer walls 504*a,b* (e.g., the surfaces facing the mold 200) to have a high radiosity and, therefore, be able to substantially redirect the radiated thermal energy back towards the mold 200. Likewise, the back surfaces of the inner and outer walls 504*a,b* may be prepared such that each exhibits low radiosity or insulating properties. Moreover, in some embodiments, the radiosity of the front surfaces of one or both of the inner and outer walls 504*a,b* may further be enhanced by polishing the front surfaces so that a highly polished surface results.

In some embodiments, the radiant barrier 502 may be a free-standing structure, separate from the insulation enclosure 500. In other embodiments, however, the radiant barrier 502 may be coupled to the inner surface(s) of the support structure 306 (e.g., the inner frame 216) at one or more discrete locations. In some embodiments, for example, the radiant barrier 502 may be coupled to the support structure 306 using the mechanical fasteners 322 (e.g., bolts, screws, pins, etc.), but may likewise (or in addition thereto) be permanently attached to the support structure 306 at one or more discrete locations by a process such as welding, brazing, or diffusion bonding, without departing from the scope of the disclosure.

The sealed chamber 506 may enclose a gas 508 therein and the gas 508 may be configured to act as an insulator for the insulation enclosure 500. Suitable gases that may be sealed within the sealed chamber include, but are not limited to, air, argon, neon, helium, krypton, xenon, oxygen, carbon dioxide, methane, nitric oxide, nitrogen, nitrous oxide, trichlorofluoromethane (R-11), dichlorodifluoromethane (R-12), dichlorofluoromethane (R-21), difluoromonochloromethane (R-22), sulphur hexafluoride, or any combination thereof. The gas 508 may be used in the sealed chamber 506 as an insulator.

In some embodiments, the sealed chamber 506 may contain at least one connection to an exterior reservoir that heats the gas 508 to provide the radiant barrier 502 with a thermal energy reservoir. In this manner, a heated gas 508 may be used to fill the sealed chamber 506 once, or a heated gas 508 may continuously cycle gas through the sealed chamber 506 to provide a suitable thermal reservoir. In other embodiments, the gas 508 may be omitted from the sealed chamber 506 and a vacuum may alternatively be formed within the sealed chamber 506.

As illustrated, the radiant barrier 502 may be coupled to the support structure 306 such that a gap 510 is defined therebetween. In some embodiments, the gap 510 may be filled with insulation material, such as the insulation material 308, and used to slow the rate of heat transfer through the insulation enclosure 500. In other embodiments, however, the gap 510 may be filled with air or another gas that may help form a secondary radiant barrier that might further help redirect the radiated thermal energy back towards the mold 200 within the insulation enclosure 500.

In yet other embodiments, or in addition thereto, a thermal barrier coating 328 may be applied to the back surface of the outer wall 504*b* within the gap 510 to further lower the rate of heat transfer through to the insulation enclosure 500. The thermal barrier coating 328 may be positioned on the back surface of the outer wall 504*b* and exhibit a lower thermal conductivity than the radiant barrier 502. Accordingly, the thermal barrier coating 328 may advantageously lower the radiosity of the back surface of the outer wall 504*b* and/or lower the heat transfer through to the insulation enclosure 500. In at least one embodiment, the thermal barrier coating 328 may alternatively (or in addition thereto) be applied to the support structure 306, such as on the inner and/or outer surfaces of either of the outer and inner frames 214, 216.

Figure 6:
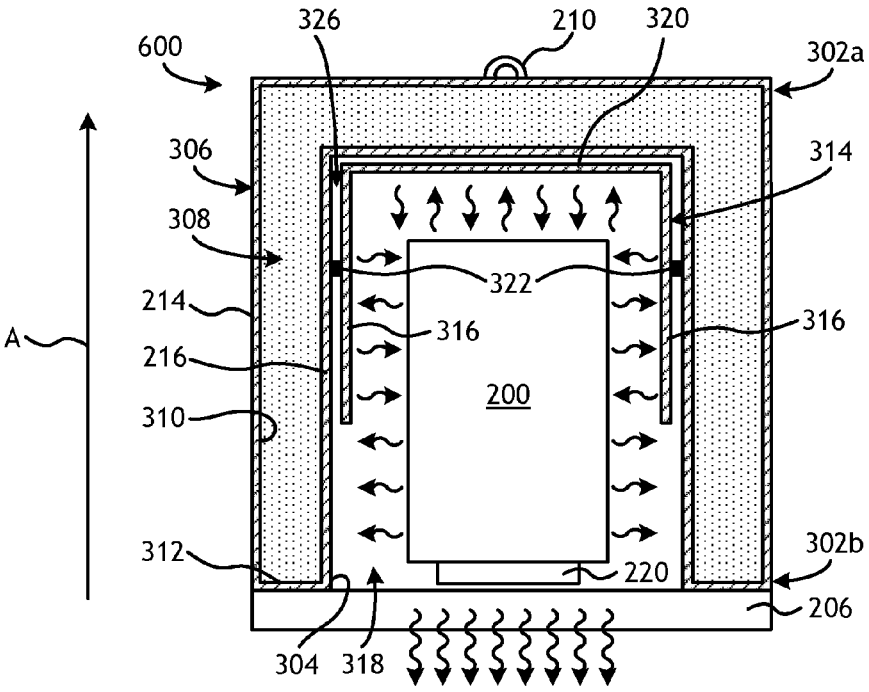
FIG. 6 illustrates a cross-sectional side view of another exemplary insulation enclosure, according to one or more embodiments.

FIG. 6 illustrates a cross-sectional side view of another exemplary insulation enclosure 600, according to one or more embodiments. The insulation enclosure 600 may be similar in some respects to the insulation enclosure 300 of FIG. 3 and therefore may be best understood with reference thereto, where like numerals represent like elements not described again. Similar to the insulation enclosure 300 the insulation enclosure 600 may include the support structure 306, including the outer and inner frames 214, 216, and the insulation material 308 supported on the support structure 306, as generally described above. Moreover, the insulation enclosure 600 may further include the radiant barrier 314 positioned within the interior of the support structure 306, as generally described above.

The radiant barrier 314 depicted in FIG. 6, however, may only partially enclose the mold 200 therein. More particularly, the length (i.e., height) of the sidewalls 316 of the radiant barrier 314 may be reduced such that the radiant barrier 314 does not interpose the mold 200 and the support structure 306 along a portion of the insulation enclosure 300 at or near the bottom end 302*b* of the support structure 306. Removing the lower portion(s) of the sidewalls 316 may alter or otherwise vary one or more thermal properties of the insulation enclosure 600 in a longitudinal direction A, thereby yielding higher insulating properties in the topmost regions of the insulating can 300 and lower insulating properties in the bottommost regions.

Exemplary thermal properties that may be varied in the longitudinal direction A by removing a portion of the sidewalls 316 of the radiant barrier 314 include, but are not limited to, radiosity, reflectivity, emissivity, absorptivity, surface characteristics (e.g., roughness, coating, paint, etc.), R-value (insulative capacity), thermal conductivity, specific heat capacity, density, and thermal diffusivity.

As will be appreciated, instead of removing a portion of the sidewalls 316, a similar effect may result by varying the materials and/or thermal properties of the radiant barrier 314 in the longitudinal direction A such that the radiant barrier 314 has a lower radiosity at or near the bottom end 302*b* of the structure 306 and has a higher radiosity at or near the top end 302*a*. As a result, the rate of thermal energy loss through the insulation enclosure 600 may be graded in the longitudinal direction A, with most thermal energy being lost out of the bottommost region at or near the bottom end 302*b*, which may facilitate a more controlled cooling process for the mold 200 and optimize the directional solidification of the molten contents within the mold 200. Through directional solidification, any potential defects (e.g., voids) may be more effectively pushed or otherwise urged toward the top regions of the mold 200 where they can be machined off later during finishing operations.

While the insulation enclosures 300, 400, 500, and 600 described herein each include a support structure 306 having outer and inner frames 214, 216 and insulation material 308 positioned therebetween, those skilled in the art will readily appreciate that variations of the support structure 306 are equally possible, without departing from the scope of the disclosure. For instance, in at least one embodiment, the radiant barrier used in a given insulation enclosure may be sufficiently effective such that the insulation material 308 supported by the support structure 306 may be omitted or otherwise reduced. Moreover, it will further be appreciated that the embodiments disclosed in all of FIGS. 3-6 may be combined in any combination, in keeping within the scope of this disclosure.

Embodiments disclosed herein include:

A. An insulation enclosure that includes a support structure having at least an inner frame and providing a top end, a bottom end, and an opening defined in the bottom end for receiving a mold within an interior of the support structure, and a radiant barrier positioned within the interior of the support structure, the radiant barrier including a front surface arranged to face the mold and a back surface facing the support structure, wherein the radiant barrier interposes the mold and the support structure to redirect thermal energy radiated from the mold back towards the mold.

B. A method that includes removing a mold from a furnace, the mold having a top and a bottom, placing the mold on a thermal heat sink with the bottom adjacent the thermal heat sink, lowering an insulation enclosure around the mold, the insulation enclosure including a support structure having at least an inner frame and providing a top end, a bottom end, and an opening defined in the bottom end for receiving the mold within an interior of the support structure, the insulation enclosure further including a radiant barrier positioned within the interior of the support structure, and redirecting thermal energy radiated from the mold back towards the mold with the radiant barrier, the radiant barrier including a front surface arranged to face the mold and a back surface facing the support structure.

Each of embodiments A and B may have one or more of the following additional elements in any combination: Element 1: further comprising insulation material supported by the support structure, the insulation material being selected from the group consisting of ceramics, ceramic fibers, ceramic fabrics, ceramic wools, ceramic beads, ceramic blocks, moldable ceramics, woven ceramics, cast ceramics, fire bricks, carbon fibers, graphite blocks, shaped graphite blocks, polymer beads, polymer fibers, polymer fabrics, nanocomposites, fluids in a jacket, metal fabrics, metal foams, metal wools, metal castings, metal forgings, any composite thereof, and any combination thereof. Element 2: wherein the support structure further provides an outer frame and the insulation material is positioned within a cavity defined between the outer and inner frames. Element 3: wherein the support structure further provides a footing at the bottom end and the insulation material is at least partially supported by the footing. Element 4: wherein the radiant barrier is coupled to the inner frame using at least one of one or more mechanical fasteners and a permanent attachment. Element 5: wherein the front surface is a highly polished surface that increases a reflectivity of the front surface. Element 6: wherein the radiant barrier is made of a material selected from the group consisting of aluminum oxide, aluminum nitride, silicon carbide, silicon nitride, quartz, titanium carbide, titanium nitride, borides, carbides, nitrides, oxides, iron, chromium, copper, carbon steel, maraging steel, stainless steel, microalloyed steel, low alloy steel, molybdenum, nickel, platinum, silver, gold, tantalum, tungsten, titanium, aluminum, cobalt, rhenium, osmium, palladium, iridium, rhodium, ruthenium, manganese, niobium, vanadium, zirconium, hafnium, and any alloy based thereon.

Element 7: wherein a gap is defined between the radiant barrier and the support structure, and wherein the gap is at least partially filled with an insulation material. Element 8: further comprising a thermal barrier coating applied to at least one of the back surface of the radiant barrier and the support structure. Element 9: further comprising a second radiant barrier positioned within the interior of the support structure and interposing the radiant barrier and the support structure. Element 10: wherein a first gap is defined between the radiant barrier and the second radiant barrier, and a second gap is defined between the second radiant barrier and the support structure, and wherein one or both of the first and second gaps is at least partially filled with an insulation material. Element 11: further comprising a thermal barrier coating applied to at least one of the back surface of the radiant barrier, a back surface of the second radiant barrier, and the support structure. Element 12: wherein the radiant barrier comprises an inner wall, an outer wall, and a sealed chamber defined between the inner and outer walls and containing a vacuum or a gas selected from the group consisting of air, argon, neon, helium, krypton, xenon, oxygen, carbon dioxide, methane, nitric oxide, nitrogen, nitrous oxide, sulphur hexafluoride, trichlorofluoromethane, dichlorodifluoromethane, dichlorofluoromethane, difluoromonochloromethane, and any combination thereof. Element 13: wherein the inner frame and the outer wall are the same. Element 14: wherein the radiant barrier has one or more sidewalls that extend at least partially between the top and bottom ends, and wherein a length of the one or more sidewalls is reduced such that the radiant barrier does not interpose the mold and the support structure at or near the bottom end. Element 15: wherein one or more thermal properties of the radiant barrier vary in a longitudinal direction between the bottom and top ends. Element 16: wherein the one or more thermal properties is radiosity, and wherein the front surface has a lower radiosity at or near the bottom end and a higher radiosity at or near the top end.

Element 17: further comprising insulating the mold with insulation material supported by the support structure, the insulation material being selected from the group consisting of ceramics, ceramic fibers, ceramic fabrics, ceramic wools, ceramic beads, ceramic blocks, moldable ceramics, woven ceramics, cast ceramics, fire bricks, carbon fibers, graphite blocks, shaped graphite blocks, polymer beads, polymer fibers, polymer fabrics, nanocomposites, fluids in a jacket, metal fabrics, metal foams, metal wools, metal castings, metal forgings, any composite thereof, and any combination thereof. Element 18: wherein a gap is defined between the radiant barrier and the support structure and the gap is at least partially filled with an insulation material, the method further comprising insulating the mold with the insulation material positioned within the gap. Element 19: wherein the insulation enclosure further includes a second radiant barrier positioned within the interior of the support structure and interposing the radiant barrier and the support structure, and wherein a first gap is defined between the radiant barrier and the second radiant barrier, and a second gap is defined between the second radiant barrier and the support structure, the method further comprising insulating the mold with insulation material positioned at least partially within at least one of the first and second gaps. Element 20: wherein the radiant barrier includes an inner wall, an outer wall, and a sealed chamber defined between the inner and outer walls and containing a vacuum or a gas, the method further comprising insulating the mold with the vacuum or the gas contained within the sealed chamber, the gas being selected from the group consisting of air, argon, neon, helium, krypton, xenon, oxygen, carbon dioxide, methane, nitric oxide, nitrogen, nitrous oxide, sulphur hexafluoride, trichlorofluoromethane, dichlorodifluoromethane, dichlorofluoromethane, difluoromonochloromethane, and any combination thereof. Element 21: wherein the radiant barrier exhibits one or more thermal properties, the method further comprising varying at least one of the one or more thermal properties in a longitudinal direction between the bottom and top ends. Element 22: further comprising drawing thermal energy from the bottom of the mold with the thermal heat sink.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. An insulation enclosure, comprising:

a support structure having at least an inner frame and providing a top end, a bottom end, and an opening defined in the bottom end for receiving a mold within an interior of the support structure;

a radiant barrier positioned within the interior of the support structure, the radiant barrier including a front surface arranged to face the mold when the mold is arranged within the interior and a back surface facing the support structure, wherein the radiant barrier interposes the mold and the support structure and redirects thermal energy toward the mold; and insulation material supported by the support structure, wherein the support structure further provides an outer frame and the insulation material is positioned within a cavity defined between the outer frame and the inner frame.

2. The insulation enclosure of claim 1, the insulation material being selected from the group consisting of ceramic, ceramic fiber, ceramic fabric, ceramic wool, ceramic beads, ceramic blocks, moldable ceramic, woven ceramic, cast ceramic, fire brick, carbon fibers, graphite blocks, shaped graphite blocks, polymer beads, polymer fiber, polymer fabric, a nanocomposite, a fluid in a jacket, metal fabric, metal foam, metal wool, a metal casting, a metal forging, any composite thereof, any derivative thereof, and any combination thereof.

3. The insulation enclosure of claim 2, wherein the support structure further provides a footing at the bottom end at least partially supporting the insulation material.

4. The insulation enclosure of claim 1, wherein the radiant barrier is coupled to the inner frame using at least one of one or more mechanical fasteners and a permanent attachment.

5. The insulation enclosure of claim 1, wherein the front surface is a polished surface.

6. The insulation enclosure of claim 1, wherein the radiant barrier is made of a material selected from the group consisting of aluminum oxide, aluminum nitride, silicon carbide, silicon nitride, quartz, titanium carbide, titanium nitride, a boride, carbides, a nitride, an oxide, iron, chromium, copper, carbon steel, maraging steel, stainless steel, microalloyed steel, low alloy steel, molybdenum, nickel, platinum, silver, gold, tantalum, tungsten, titanium, aluminum, cobalt, rhenium, osmium, palladium, iridium, rhodium, ruthenium, manganese, niobium, vanadium, zirconium, hafnium, any derivative thereof, and any alloy based thereon.

7. The insulation enclosure of claim 1, wherein a gap is defined between the radiant barrier and the support structure, and wherein the gap is at least partially filled with an insulation material.

8. The insulation enclosure of claim 1, further comprising a thermal barrier coating applied to at least one of the back surface of the radiant barrier and the support structure.

9. The insulation enclosure of claim 1, further comprising a second radiant barrier positioned within the interior of the support structure and interposing the radiant barrier and the support structure.

10. The insulation enclosure of claim 9, wherein a first gap is defined between the radiant barrier and the second radiant barrier, and a second gap is defined between the second radiant barrier and the support structure, and wherein one or both of the first and second gaps is at least partially filled with an insulation material.

11. The insulation enclosure of claim 9, further comprising a thermal barrier coating applied to at least one of the back surface of the radiant barrier, a back surface of the second radiant barrier, and the support structure.

12. The insulation enclosure of claim 1, wherein the radiant barrier comprises:

an inner wall;

an outer wall; and a sealed chamber defined between the inner and outer walls and containing a vacuum or a gas selected from the group consisting of: air, argon, neon, helium, krypton, xenon, oxygen, carbon dioxide, methane, nitric oxide, nitrogen, nitrous oxide, sulphur hexafluoride, trichlorofluoromethane, dichlorodifluoromethane, dichlorofluoromethane, difluoromonochloromethane, any derivative thereof, and any combination thereof.

13. The insulation enclosure of claim 12, wherein the inner frame and the outer wall are the same structure.

14. The insulation enclosure of claim 1, wherein the radiant barrier has one or more sidewalls that extend at least partially between the top and bottom ends, and wherein a length of the one or more sidewalls is reduced such that the radiant barrier does not interpose the mold and the support structure at or near the bottom end.

15. The insulation enclosure of claim 1, wherein one or more thermal properties of the radiant barrier vary in a longitudinal direction between the bottom and top ends.

16. The insulation enclosure of claim 15, wherein the one or more thermal properties is radiosity, and wherein the front surface has a lower radiosity at or near the bottom end and a higher radiosity at or near the top end.

17. An insulation enclosure, comprising:

a support structure having at least an inner frame and providing a top end, a bottom end, and an opening defined in the bottom end for receiving a mold within an interior of the support structure; and a radiant barrier positioned within the interior of the support structure, the radiant barrier including a front surface arranged to face the mold when the mold is arranged within the interior and a back surface facing the support structure, wherein the radiant barrier interposes the mold and the support structure and redirects thermal energy toward the mold;

wherein the radiant barrier comprises:

an inner wall;

an outer wall; and a sealed chamber defined between the inner and outer walls and containing a vacuum or a gas.

18. The insulation enclosure of claim 17, wherein the gas is selected from the group consisting of: air, argon, neon, helium, krypton, xenon, oxygen, carbon dioxide, methane, nitric oxide, nitrogen, nitrous oxide, sulphur hexafluoride, trichlorofluoromethane, dichlorodifluoromethane, dichlorofluoromethane, difluoromonochloromethane, any derivative thereof, and any combination thereof.

19. The insulation enclosure of claim 17, wherein the inner frame and the outer wall are the same structure.

20. An insulation enclosure, comprising:

a support structure having at least an inner frame and providing a top end, a bottom end, and an opening defined in the bottom end for receiving a mold within an interior of the support structure; and a radiant barrier positioned within the interior of the support structure, the radiant barrier including a front surface arranged to face the mold when the mold is arranged within the interior and a back surface facing the support structure, wherein the radiant barrier interposes the mold and the support structure and redirects thermal energy toward the mold, wherein one or more thermal properties of the radiant barrier vary in a longitudinal direction between the bottom and top ends.

21. The insulation enclosure of claim 20, wherein the one or more thermal properties is radiosity, and wherein the front surface has a lower radiosity at or near the bottom end and a higher radiosity at or near the top end.

* * * * *